US008789972B2

(12) United States Patent
Plumb et al.

(10) Patent No.: US 8,789,972 B2
(45) **Date of Patent: *Jul. 29, 2014**

(54) LIGHTED MOVING BALL DISPLAY SYSTEM

(76) Inventors: Lloyd R. Plumb, Woods Cross, UT (US); Lola Melody Howard Plumb, Woods Cross, UT (US)

( * ) Notice: Subject to any disclaimer, the term of this patent is extended or adjusted under 35 U.S.C. 154(b) by 195 days.

This patent is subject to a terminal disclaimer.

(21) Appl. No.: 13/221,709

(22) Filed: Aug. 30, 2011

(65) Prior Publication Data

US 2012/0008313 A1 Jan. 12, 2012

Related U.S. Application Data

(63) Continuation-in-part of application No. 12/830,921, filed on Jul. 6, 2010, now Pat. No. 8,348,466.

(60) Provisional application No. 61/224,535, filed on Jul. 10, 2009.

(51) Int. Cl.
*F21V 33/00* (2006.01)
*F21V 21/00* (2006.01)

(52) U.S. Cl.
USPC . 362/249.19; 362/564; 362/253; 362/249.16; 362/249.18; 40/375; 40/406; 40/407; 40/432

(58) Field of Classification Search
None
See application file for complete search history.

(56) References Cited

U.S. PATENT DOCUMENTS

| | | | |
|---|---|---|---|
| 1,974,472 | A | 9/1934 | Seghers |
| 4,675,575 | A | 6/1987 | Smith et al. |
| 5,066,011 | A | 11/1991 | Dykstra et al. |
| 5,112,055 | A | 5/1992 | Barnhill |
| 5,316,293 | A | 5/1994 | Hamilton |
| 5,513,081 | A | 4/1996 | Byers |
| 6,428,432 | B1 | 8/2002 | Kachel |
| 6,666,782 | B1 | 12/2003 | Wu |
| 6,848,819 | B1 | 2/2005 | Arndt et al. |
| 6,991,351 | B1 | 1/2006 | Petrick |
| 7,029,129 | B2 | 4/2006 | Shimada |
| 7,235,930 | B1 | 6/2007 | Hsu |
| 7,274,160 | B2 | 9/2007 | Mueller et al. |
| 7,276,858 | B2 | 10/2007 | Allen |
| 7,279,809 | B2 | 10/2007 | Janning |

*Primary Examiner* — Sikha Roy
(74) *Attorney, Agent, or Firm* — JP Webb; Jason P. Webb; Danny H. Y. Cheng

(57) ABSTRACT

A lighted moving ball display system configured to provide a visual display, such as in a Christmas tree. The system includes a plurality of light emitting balls. The light emitting balls each include a light emitting device, a ball power module, and a housing configured to secure the light emitting device and the ball power module, therein. The system includes a passive transport medium configured to receive the balls and permit the balls to traverse the medium under gravitational force. The system includes a lifting mechanism functionally coupled to the medium and configured to lift the plurality of light emitting balls to a top portion of the medium. The system includes a power module configured to provide power to the modules and components of the system. The system includes a motivating apparatus configured to actively urge the plurality of light emitting balls to traverse the medium.

18 Claims, 8 Drawing Sheets

LIGHTED MOVING BALL DISPLAY SYSTEM

CROSS-REFERENCE TO RELATED APPLICATIONS

This application is a Continuation-in-Part Application of, under 35 U.S.C. §121, and claims priority to, under 35 U.S.C. §121, U.S. Non-Provisional application Ser. No. 12/830,921, entitled Lighted Moving Ball Display System, by Lloyd Plumb, filed on Jul. 6, 2010, which is incorporated by reference herein in its entirety, through which this invention claims priority, under 35 U.S.C. §120, to the U.S. Provisional Patent Application No. 61/224,535 to Lloyd Plumb filed on Jul. 10, 2009, which is incorporated by reference herein in its entirety.

BACKGROUND OF THE INVENTION

1. Field of the Invention

The present invention relates to visual displays, specifically to a lighted moving ball display systems.

2. Description of the Related Art

Decorative displays of varying types have always been a standard part of the human existence. People are highly visual and therefore such displays carry great meaning, enjoyment, and have a strong place in every culture. Decorative displays have been used to entertain, educate, thrill, enlighten, and celebrate. They bring people closer together through shared experience and may even be great works of art.

Decorative displays have taken many forms, including paintings, billboards, connected/choreographed light sources, explosives, colored/lighted wands, phosphorescent tubes, fountains, sculptures, clothing, plays, film, games, pageants, dances, and the like. As a non-limiting example, a very common decorative display in Western culture is the Christmas Tree.

The Christmas tree is one of the most popular traditions associated with the celebration of Christmas. Normally an evergreen coniferous tree that is brought into a home or used in the open, a Christmas tree is decorated with Christmas lights and colorful ornaments during the days around Christmas. Over the years, artificial Christmas trees have evolved and become popular. Most modern artificial Christmas trees are made from polyvinyl chloride (PVC) or other plastics.

Other gimmicks have developed as well. Fiber optic Christmas trees come in two major varieties; one resembles a traditional Christmas tree. One manufacturer offers "holographic mylar" trees in many hues. Tree-shaped objects made from such materials as cardboard, glass, ceramic or other materials can be found in use as tabletop decorations.

Artificial trees became increasingly popular during the late 20th century. Users of artificial Christmas trees assert that they are more convenient, and, because they are reusable, much cheaper than their natural alternative. Lighting with candles or electric lights (fairy lights) is commonly done and a tree topper, traditionally either an angel or a star, completes the ensemble.

Individual decorations vary widely, typically being an eclectic mix of family traditions and personal tastes; even a small unattractive ornament, if passed down from a parent or grandparent, may come to carry considerable emotional value and be given a place of pride on the tree. Conversely, trees decorated by professional designers for department stores and other institutions will usually have a "theme"; a set of predominant colors, multiple instances of each type of ornament, and larger decorations that may be more complicated to set up correctly. However, new lighting techniques and devices are increasing growing due to consumer demand for new and more colorful lighting displays. Some improvements have been made in the field. Examples of references related to the present invention are described below in their own words, and the supporting teachings of each reference are incorporated by reference herein:

U.S. Pat. No. 6,428,432, issued to Kachel, discloses a ball toy has an inner spherical shell within an outer spherical shell, a light source being mounted within the inner shell adjacent to a first end of a plurality of etched optical fibers having the other ends arrayed between the inner and outer shells. The outer shell is translucent while the inner shell has a coated outer surface that reflects light from the optical fibers. Between the light source and the first end of the optical fibers is a color chamber having different color elements through which light may be transmitted and which may move when the ball moves so as to vary the colors received by the optical fibers thereby effecting variation in the color seen as the ball rolls or is otherwise moved, the light seen at the translucent shell fluctuating according to the colors transmitted. A motion switch and/or a master switch may be used to turn the system on and off. A timer may deactivate the circuits if the ball is not moved after a period of time.

U.S. Pat. No. 5,054,778, issued to Maleyko, discloses a lighted ball having high velocity bounce capability which comprises a solid spherical body of soft, pliable, transparent rubber having a plurality of LEDs embedded in the body. An electrical switch with push button action is embedded in the body and connected in circuit with a battery set for energizing the LEDs. The removable closure is provided in a battery passage. A switch access passage extends from the switch actuator to the surface of the body.

U.S. Pat. No. 3,704,366, issued to Korb et al., discloses an outdoor, lighted, artificial Christmas tree decoration comprising a skeleton structure of tubular members having a vertical main support trunk and a plurality of horizontal tubular branch members radially extending outwardly from the main trunk, the trunk and the tubular branch members being detachably secured to an annular hub having included therein securing means for removably securing a plurality of downwardly depending support legs from the hub, whereby the artificial tree can be rigidly attached to a base by means of the support legs. Disposed at the upper end of the main trunk is an electrical junction box in which a plurality of downwardly-extending electrical wires are operably connected to an inlet line, the wires being removably attached at respective ends of the branch members which include clamping means fixed thereon, whereby the free ends of each wire extend horizontally to the adjacent branch member and are secured thereto. The electrical wires are provided with evenly spaced light sockets and lights which are lit when the inlet line is operably connected to a commonly used electric power source.

U.S. Pat. No. 7,270,450, issued to Chan, discloses a lighting and flashing Christmas tree structure apparatus employs a low power control circuit to control the flashing sequence of LED light strings, capable of randomly altering distribution of the light strings with free choice of colors. A plug-free magnetic power system supplies electrical power to a cuboidal body where each of the four sides thereon has an electrical power receptacle free for user selection. With a LED device controller, a magnificent blinking is emitting from the LED light source to delight Christmas atmosphere. The electrical power offered by the present invention is limited below 24 V, which is within the safety range of the electrical properties code for body contact, therefore being free of safety concerns.

The inventions heretofore known suffer from a number of disadvantages which include being limited in application, being limited in adaptability, being complex, being bulky, and being limited in use, being limited in utility and/or form, failing to catch sufficient attention, failing to attract the attention of the young, being limited in variety of expression, being mundane, and being expensive.

What is needed is a lighted moving ball display system that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available visual displays. Accordingly, the present invention has been developed to provide a moving visual art display.

According to one embodiment of the invention, there is a lighted moving ball display system that may be configured to provide a visual display. The system may include a plurality of light emitting balls. The light emitting balls may each include a light emitting device. The light emitting balls may each include a ball power module that may be configured to power the light emitting device. The light emitting balls each may include a housing that may be configured to secure the light emitting device and the ball power module, therein. The light emitting balls may each include a wireless power receiver module.

The system may include a passive transport medium that may be configured to receive the balls and may be configured to permit the balls to traverse the medium under gravitational force. The passive transport medium may include tubing.

The system may include a lifting mechanism that may be functionally coupled to the passive transport medium and may be configured to lift the plurality of light emitting balls to a top portion of the medium. The lifting mechanism may include a collection chamber that may be in communication with the medium and may be configured to collect the plurality of lighted balls after moving through the medium. The lifting mechanism may include a loading mechanism that may be in communication with the collection chamber and may be configured to load the plurality of lighted balls into the lifting mechanism. The lifting mechanism may include a lifting device that may be in communication with the loading mechanism and the collection chamber. The lifting device may include lifting means, to lift a plurality of lighted balls to a top of a medium.

The system may include a power module that may be functionally coupled to the lifting mechanism and may be configured to provide power to the modules and components of the system. The power module may include a wireless power emission module. The system may include a receptacle that may be functionally coupled to the passive transport medium and to the lifting mechanism. The receptacle may be configured to store the plurality of light emitting balls. The system may also include a motivating apparatus that may be functionally coupled to the medium and may be configured to actively urge the plurality of light emitting balls to traverse the medium. The motivating apparatus may be an air pressure generator. The medium may include a channel structure selected from the group of structures consisting of tubes, rails, tracks, ledges, ridges, banks, waves, grooves, slides, etc.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
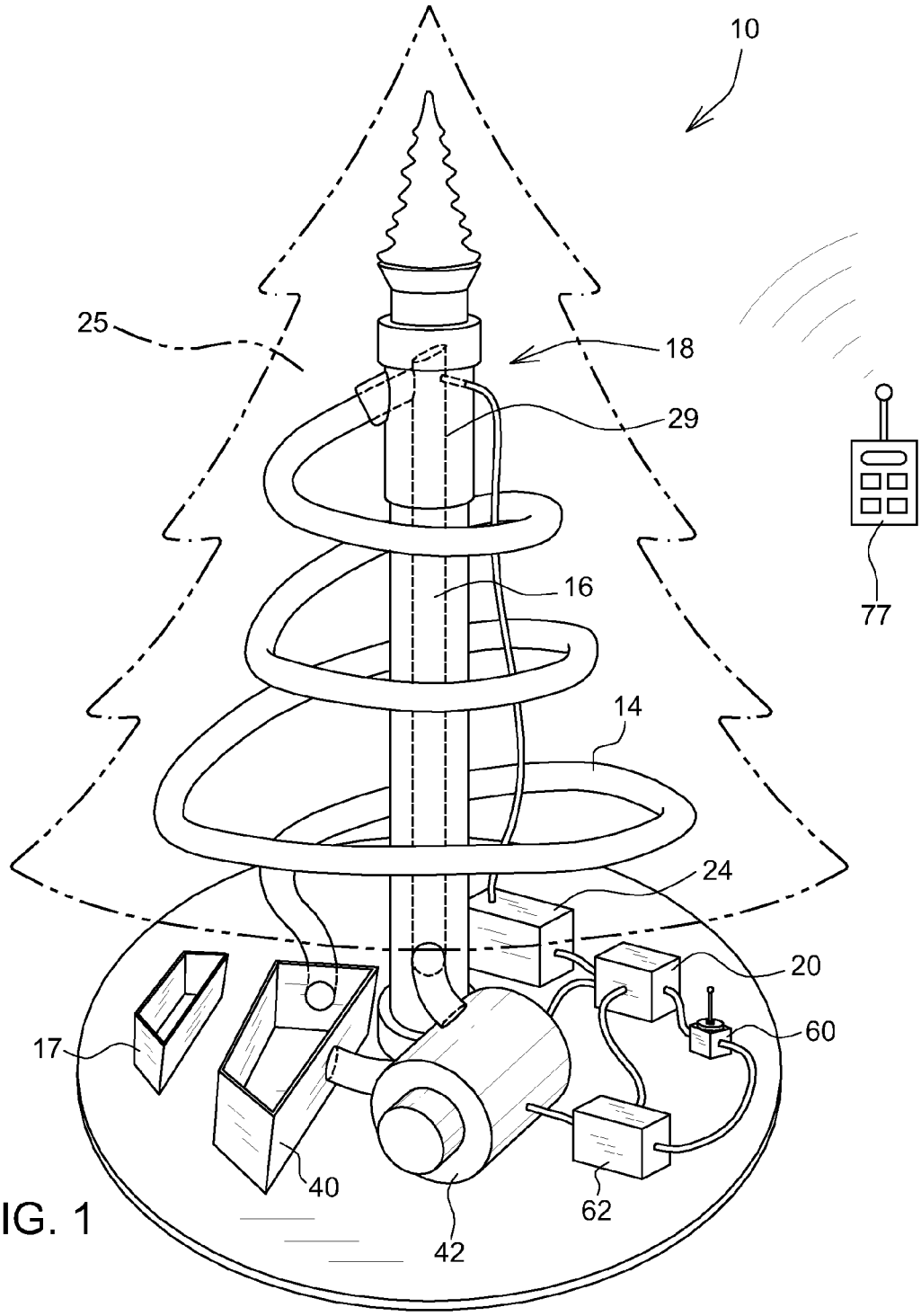
FIG. 1 is a perspective view of a lighted moving ball display system embodied as a Christmas Tree, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Many of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like.

Modules may also be implemented in software for execution by various types of processors. An identified module of programmable or executable code may, for instance, comprise one or more physical or logical blocks of computer instructions which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure.

The operational data may be collected as a single data set, or may be distributed over different locations including over different storage devices, and may exist, at least partially, merely as electronic signals on a system or network.

The various system components and/or modules discussed herein may include one or more of the following: a host server or other computing systems including a processor for processing digital data; a memory coupled to said processor for storing digital data; an input digitizer coupled to the processor for inputting digital data; an application program stored in said memory and accessible by said processor for directing processing of digital data by said processor; a display device coupled to the processor and memory for displaying information derived from digital data processed by said processor; and a plurality of databases. As those skilled in the art will appreciate, any computers discussed herein may include an operating system (e.g., Windows Vista, NT, 95/98/2000, OS2; UNIX; Linux; Solaris; MacOS; and etc.) as well as various conventional support software and drivers typically associated with computers. The computers may be in a home or business environment with access to a network. In an exemplary embodiment, access is through the Internet through a commercially-available web-browser software package.

The present invention may be described herein in terms of functional block components, screen shots, user interaction, optional selections, various processing steps, and the like. Each of such described herein may be one or more modules in exemplary embodiments of the invention. It should be appreciated that such functional blocks may be realized by any number of hardware and/or software components configured to perform the specified functions. For example, the present invention may employ various integrated circuit components, e.g., memory elements, processing elements, logic elements, look-up tables, and the like, which may carry out a variety of functions under the control of one or more microprocessors or other control devices. Similarly, the software elements of the present invention may be implemented with any programming or scripting language such as C, C++, Java, COBOL, assembler, PERL, Visual Basic, SQL Stored Procedures, AJAX, extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" with other functional units and/or modules. Being "in communication" refers to any manner and/or way in which functional units and/or modules, such as, but not limited to, computers, laptop computers, PDAs, modules, and other types of hardware and/or software, may be in communication with each other. Some non-limiting examples include communicating, sending, and/or receiving data and metadata via: a network, a wireless network, software, instructions, circuitry, phone lines, internet lines, satellite signals, electric signals, electrical and magnetic fields and/or pulses, and/or so forth.

As used herein, the term "network" may include any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, simultaneous power/data transmission, transponder communications, local area network (LAN), wide area network (WAN), networked or linked devices and/or the like. Moreover, although the invention may be implemented with TCP/IP communications protocols, the invention may also be implemented using IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

FIG. 1 is a perspective view of a lighted moving ball display system embodied as a Christmas Tree, according to one embodiment of the invention. There is shown a lighted moving ball display system 10 disposed within a Christmas tree 25 decorative display, the system includes a passive transport medium 14, a control module 62, a power module 20, a communication module 60, a loading module 42, a motivating apparatus 24, a lifting module 16, a collection module 40, and a receptacle 17.

The illustrated lighted moving ball display system 10 is configured to provide a visual display. The system 10 includes a plurality of light emitting balls traveling through a passive transport medium 14 configured to receive the plurality of balls and configured to permit the plurality of balls to traverse the transport medium 14 under gravitational force. The illustrated passive transport medium 14 includes tubing in a spiral configuration configured to be disposed within a Christmas tree 25 and provide a lighted display therethrough. Wherein the medium 14 itself directly imparts kinetic energy above and beyond any transformation of gravitational potential energy to a lighted ball (such as but not limited to spring-loaded kickers, air jets, launchers, and the like), the medium 14 is active, otherwise it is passive.

The illustrated lighted moving ball display system 10 includes a control module 62 functionally coupled to and configured to provide operational controls to one or more of the components and/or modules of the system 10. The control module is configured to provide operational instructions to the components and modules of the system 10 to provide a visual display. The control module includes a plurality of programmable sequences configured to provide varying visual displays. The control module may control one or more of the other modules, such as but not limited to altering a function state (on/off, fast/slow, reverse/forward, etc.) and/or coordinating such with function states of one or more of the other modules. Non-limiting examples of a control module may be a control module described in U.S. Pat. No. 5,430,836, issued to Wolf et al.; or a control module described in U.S. Pat. No. 6,243,635, issued to Swan et al. which are incorporated for their supported teachings herein. A control module may include but is not limited to a processor, a state machine, a script, a decision tree, a protocol, a live data feed, a blended control feed, and the like and combinations thereof.

The illustrated system 10 includes a power module 20 functionally coupled to the components and modules of the system 10 and configured to provide power thereto. The power module may include an AC power supply, a battery, or the like and combinations thereof. The power module may include a wireless power emission/transmission module such as but not limited to: one or more Powercast wireless Powercaster Transmitters and Powerharvester receivers produced by Powercast Corporation, 566 Alpha Drive, Pittsburgh, Pa. 15238 and/or a Piezoelectric Energy Harvesting Power Supply produced by Linear Technology, 1630 McCarty Blvd., Milpitas, Calif., 95035.

The illustrated lighted moving ball display system 10 includes a communication module 60 configured to provide communication capabilities to the system 10. The communication module is in remote communication with a remote control 77 of the system 10. The remote control 77 is configured to send wireless communication instructions to the control module 62 through the communication module 60, thereby providing remote access and instructions to the lighted moving ball display 10. Such may include one or more transmitters/receivers that may operate on radio frequencies, through magnetic induction, light beams, and the like and combinations thereof. Non-limiting examples of a communication module may be but not limited to: a communication module described in U.S. Pat. No. 5,307,463, issued to Hyatt et al.; or a communication module described in U.S. Pat. No. 6,133,886, issued to Fariello et al. which are incorporated for their supported herein.

The illustrated lighted moving ball display system 10 includes a lifting mechanism 16 functionally coupled to the passive transport medium 14 and configured to lift a plurality of light emitting balls to a top portion 18 of the transport medium 14. The lifting mechanism 16 includes a lifting device 29 having a lifting device(s)/structure(s), to lift a plurality of lighted balls to a top portion 18 of the medium 14, such as but not limited to pumps, chain lifts, screws, augers, fluid jets, pneumatics, springs, magnets, lighter-than-air configurations, explosives, and the like and combinations thereof. The lifting device includes sufficient guide materials/devices/structures (as illustrated, tubing) to sufficiently ensure that the lighted balls arrive in a usable manner (orientation, speed, rotation, etc.) such that they may cooperatively interact with the display medium. Non-limiting examples of a lifting mechanism 16 may be a ball lift as described in U.S. Pat. No. 2,803,463, issued to Congelli et al.; or an elevating apparatus as described in U.S. Pat. No. 4,103,767, issued to Warner; both of which are incorporated for their supported teachings herein.

The illustrated lighted moving ball display system 10 includes a collection chamber 40 in communication with the transport medium 14. The collection chamber 40 is disposed at an end of the transport medium 14 and configured to collect the plurality of lighted balls after moving through the transport medium 14, thereby forming a circuit or cyclical configuration. The illustrated collection medium may also be utilized by a user to initially "load" the system with lighted balls. Such may include a chamber having an inlet port in communication with a transport medium and an outlet port in communication with a loading mechanism. Such may further include an input aperture that may be selectably closable and may be utilized to insert lighted balls into the system. Non-limiting examples of a collection chamber 40 may be a first chamber as described in U.S. Pat. No. 6,375,186, issued to Joo; or a ball collector as described in U.S. Pat. No. 4,112,911, issued to Petrick Sr.; both of which are incorporated for their supported teachings herein.

The illustrated system 10 includes a loading mechanism 42 in communication with the collection chamber 40 and the lifting mechanism 16. The loading mechanism 42 is configured to receive a plurality of lighted balls from the collection chamber 40. The loading mechanism 42 is configured to load the plurality of lighted balls into the lifting mechanism 16, thereby completing a circuit or cyclical configuration of the system 10. Such may include one or more ball moving devices such as but not limited to augers, levers, motors, pumps, kickers, pistons, valves, chambered cylinders, or the like or combinations thereof. Such may load and/or dispense lighted balls in a controlled manner such that an exact number of balls may be loaded/dispensed and such may be at a predetermined and/or selectable rate. Non-limiting examples of a loading mechanism 42 may be a ball loading machine as described in U.S. Pat. No. 2,407,016, issued to Kalister et al.; or a loading device as described in U.S Patent Publication No.: 2002/0059927, by Woods; both of which are incorporated for their supported teachings herein.

The illustrated lighted moving ball display system 10 includes a motivating apparatus 24 functionally coupled to a top portion 18 of the transport medium 14. The motivating apparatus 24 is configured to actively urge the plurality of light emitting balls to traverse through the transport medium 14. The illustrated motivating apparatus 24 is an air pressure generator and connecting hose coupled to a portion of the system wherein increased air pressure at a top portion of the system may help propel lighted balls down the illustrated passive medium. Other non-limiting examples of a motivating apparatus include progressive magnetic rails, kickers, spring-loaded ejectors, pressurized fluid jets, devices that generate spin in the lighted balls, motorized tracks, motorized devices within the balls themselves, and the like and combinations thereof. Non-limiting examples of a motivating apparatus may be a oscillating air pressure generator as described in U.S. Pat. No. 6,694,976, issued to Takaki et al.; or a pressure generator as described in U.S. Pat. No. 981,339, issued to Warren; both of which are incorporated for their supported teachings herein.

The illustrated system 10 includes a receptacle 17 functionally coupled to a base of the lighted moving ball display system 10 and configured to store a plurality of light emitting balls, when not in operation. The receptacle 17 is configured to store extra light emitting balls for use with the system 10. Such may include a simple container, bag, box, chamber or the like or combinations thereof.

In operation a user may load balls into the system, activate the system, thereby causing transport of the balls to the medium wherein they may progress through the medium for display according to a pattern that may be determined by a control module. As a non-limiting example, the control module may cause lighted balls to enter the medium according to a pattern at least partially determined by rhythm data from a MIDI data stream associated with a musical presentation that may be part of the system.

Figure 2:
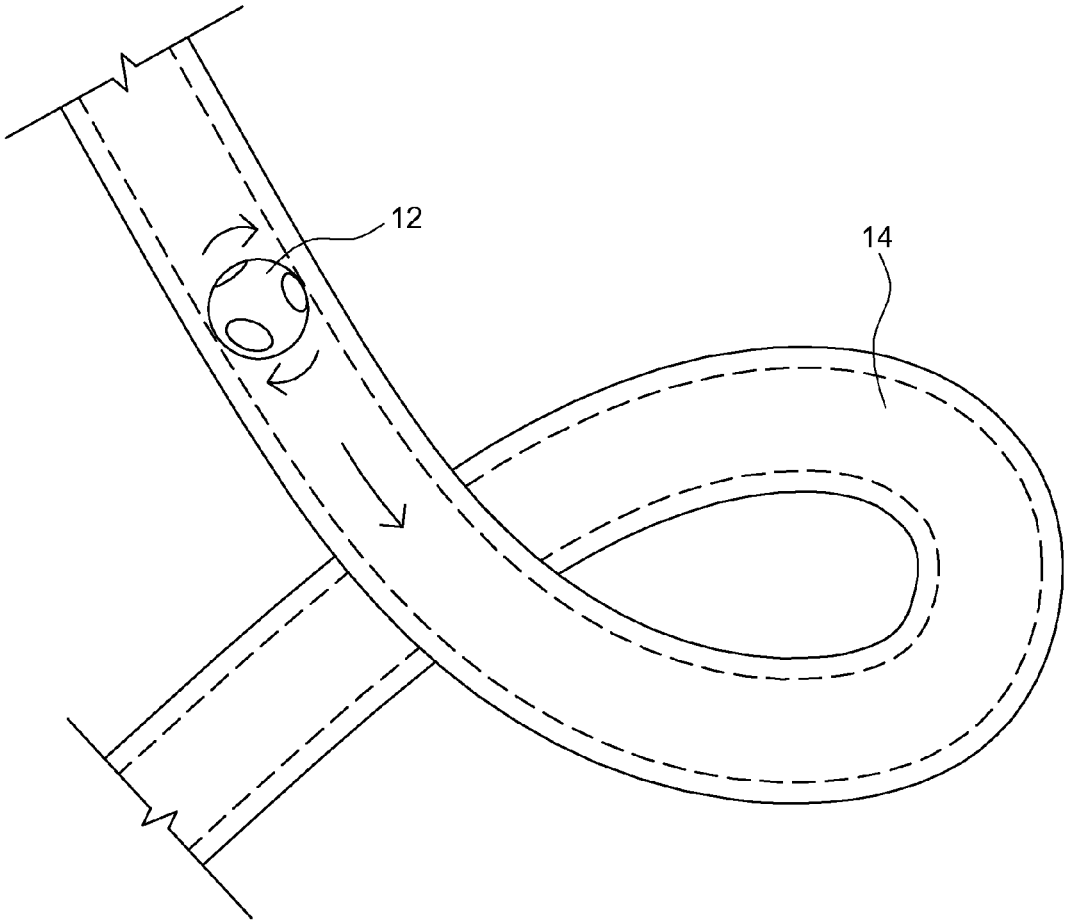
FIG. 2 is a partial view of a light emitting ball travelling through a medium of the lighted moving ball display system, according to one embodiment of the invention.

FIG. 2 is a partial view of a light emitting ball travelling through a medium of the lighted moving ball display system, according to one embodiment of the invention. There is shown a light emitting ball 12 traversing through a passive transport medium 14.

The illustrated light emitting ball 12 is traversing through a passive transport medium 14. The light emitting ball 12 is configured to travel within the transport medium 14 from a top portion of a display medium to a bottom portion of a display medium. The illustrated light emitting ball 12 is configured to traverse through the illustrated medium 14 with gravitational force assisting the movement therethrough. The illustrated medium may include a tubing structure that may include plastic, metal, glass, rubber, and the like and combinations thereof. The illustrated medium may be transparent, translucent, and/or opaque along portions thereof. The light emitting ball may be assisted along the medium by a motivating apparatus configured to assist the ball 12 while traversing the medium 14. Such a motivating apparatus may include a device for pressurizing air/fluid in communication with an interior of the medium and/or a device that may act on the lighted ball 12 from a distance, such as but not limited to electromagnetic rails along portions of the medium, such as but not limited to those systems used in rail guns. Electrified rails may also be incorporated to provide power to the ball via electrical contact pads located on the surface of the ball and connected to the light producing device(s) inside the ball.

Figure 3:
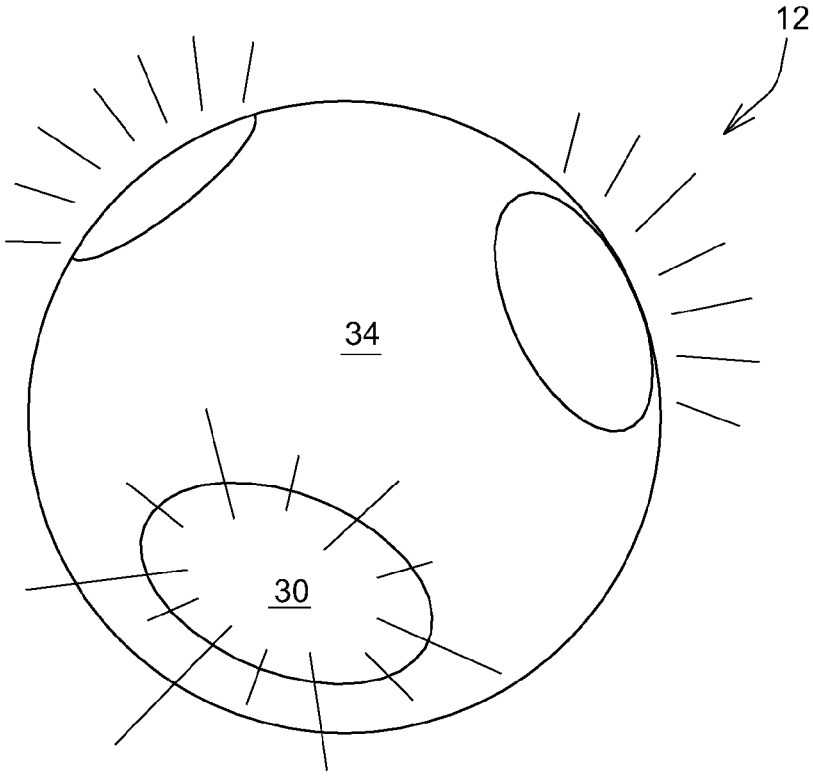
FIG. 3 is perspective view of a light emitting ball of a lighted moving ball display system, according to one embodiment of the invention.

FIG. 3 is perspective view of a light emitting ball of a lighted moving ball display system, according to one embodiment of the invention. There is shown a ball housing including a plurality of lighted sections and/or apertures/windows whereby light may emit therefrom. Wherein light emits from "point sources" (as shown) travel of the ball (involving rotation thereof) may advantageously cause a strobe or flicker effect for viewers. Light may be altered from its original source characteristics such as but not limited to being diffused, polarized, focused, dimmed, colored, filtered or the like or combinations thereof by one or more filters, devices, structures, or the like or combinations thereof.

Figure 4:
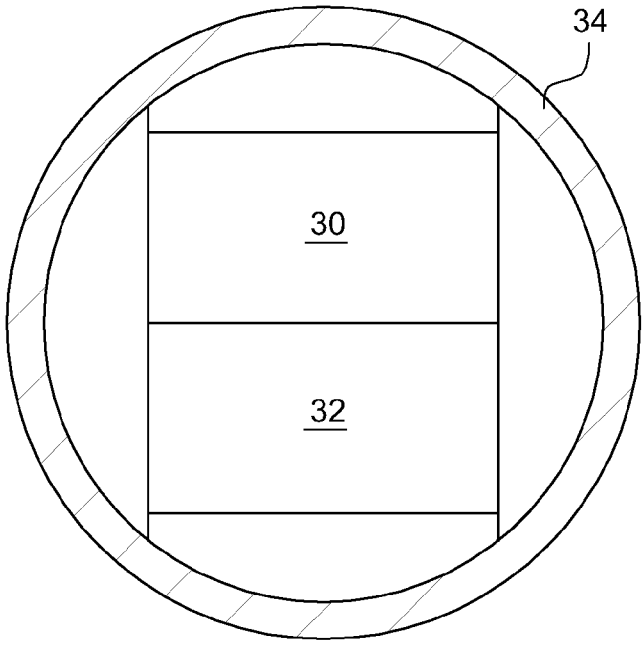
FIG. 4 is a cross-sectional view of a light emitting ball of a lighted moving ball display system, according to one embodiment of the invention.

FIG. 4 is a cross-sectional view of a light emitting ball of a lighted moving ball display system, according to one embodiment of the invention. There is shown light emitting ball 12 of a lighted moving ball display system.

The illustrated light emitting ball 12 includes a light emitting device 30 illuminating through a housing 34. The light emitting ball 12 includes a ball power module 32 configured to power the light emitting device 30. A ball power module 32 may include one or more of the following devices/modules: battery, power receiver, power transformer, power collector, communication module, and the like and combinations thereof. The ball power module 32 is in electrical communication with the light emitting device 30. A light emitting device 30 may include an incandescent bulb, a light emitting diode (LED), or the like or combinations thereof. The light emitting ball 12 includes a housing 34 configured to secure the light emitting device 30 and the ball power module 32, therein. The housing may include a plurality of layers of materials that may each have one or more of the following properties: transparent, translucent, elastic, plastic, opaque, reflective, electrically conductive, water-resistant, waterproof, and the like. The light emitting ball 12 includes a wireless power receiver module configured to receive and provide wireless power to the light emitting device 30 of the light emitting ball 12.

Figure 5:
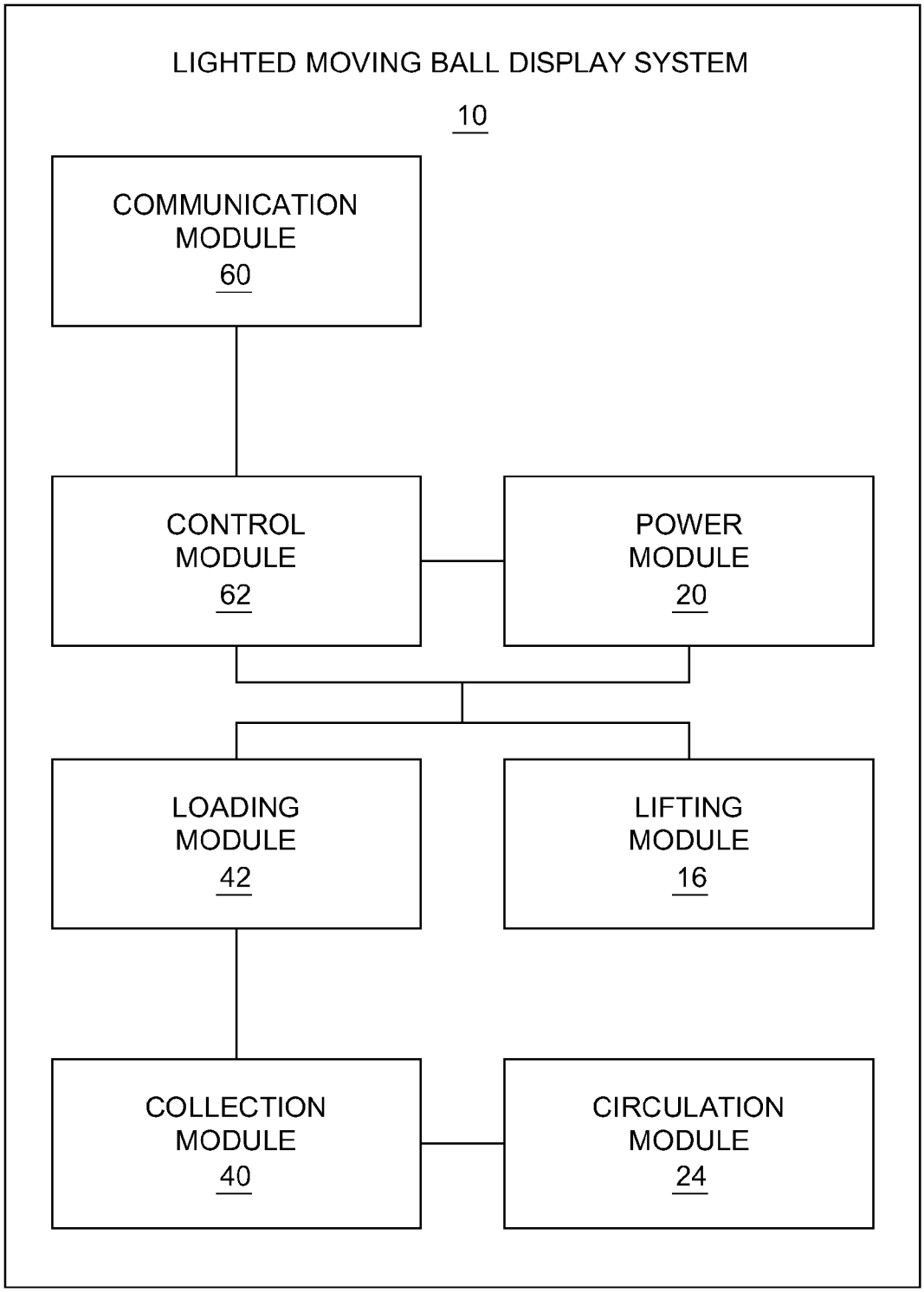
FIG. 5 is a module diagram of a lighted moving ball display system, according to one embodiment of the invention.

FIG. 5 is a module diagram of a lighted moving ball display system, according to one embodiment of the invention. There is shown lighted moving ball display system 10 including a communication module 60, a control module 62, a power module 20, a loading module 42, a lifting module 16, a collection module 40, and a circulation module 24.

The illustrated lighted moving ball display system 10 includes a power module 20 configured to provide power to the modules and components of the lighted moving ball display system 10. The power module 20 may include one or more transformers, batteries, safety circuits, switches or other electrical components or devices for changing, controlling, conditioning, storing, or otherwise providing power having desired characteristics. Such devices are well known in the art.

The lighted moving ball display system 10 also includes a control module 62 configured to control aspects of the lighted moving ball display system 10, such as, but not limited to: timing, color configuration, lighting configuration, speed configuration, etc., and operation of the components and modules of the lighted moving ball display system. A control module may include logic circuitry, switches, interfaces, and/or controls according to the desired control of the device and such may be interfaced as appropriate with other modules in order to serve such control purposes. Such may include PLC systems, simple switches, software control interfaces, remote control interfaces, and/or physical devices configured to alter operation of the display, such as but not limited to levers, binary tube channel selection devices, selectable tube blockers, doors, and the like.

The lighted moving ball display system 10 includes a circulation module 24. In one example the circulation module 24 includes an air pressure generator in communication with a medium and configured to urge a plurality of light emitting balls through a display medium. The medium is configured to decoratively associate with a tubing; wherein a plurality of lighted balls roll through the medium. A circulation module may include a medium, a track, and/or other systems, structures, and devices configured to provide for desired display and/or circulation of the lighted balls. Non-limiting examples include: tubing, tracks, rails, fluid jets, reservoirs, chambers, tubes, pumps, launchers, funnels, nets, decorative members, decorative displays, and the like.

The lighted moving ball display system 10 includes a loading module 42 configured to store the plurality of lighted balls and load the lighted balls into a lifting module 16, when in operation. The lifting module 16 is configured to lift the plurality of lighted balls to a top portion of the medium. The plurality of lighted balls are configured to roll through the medium from the top portion of the medium to a bottom portion.

The lighted moving ball display system 10 also includes a collection module 40 configured to collect the plurality of lighted balls after the lighted balls roll through the medium. The collection module 40 is in communication with the loading module 42, wherein the plurality of lighted balls collects into the collection module 40 and then is moved to the loading module 42 to continue through the medium. Furthermore, the lighted moving ball display system 10 includes a communication module 60 configured to send/receive data from the system to a network or wireless remote controller.

Figure 6:
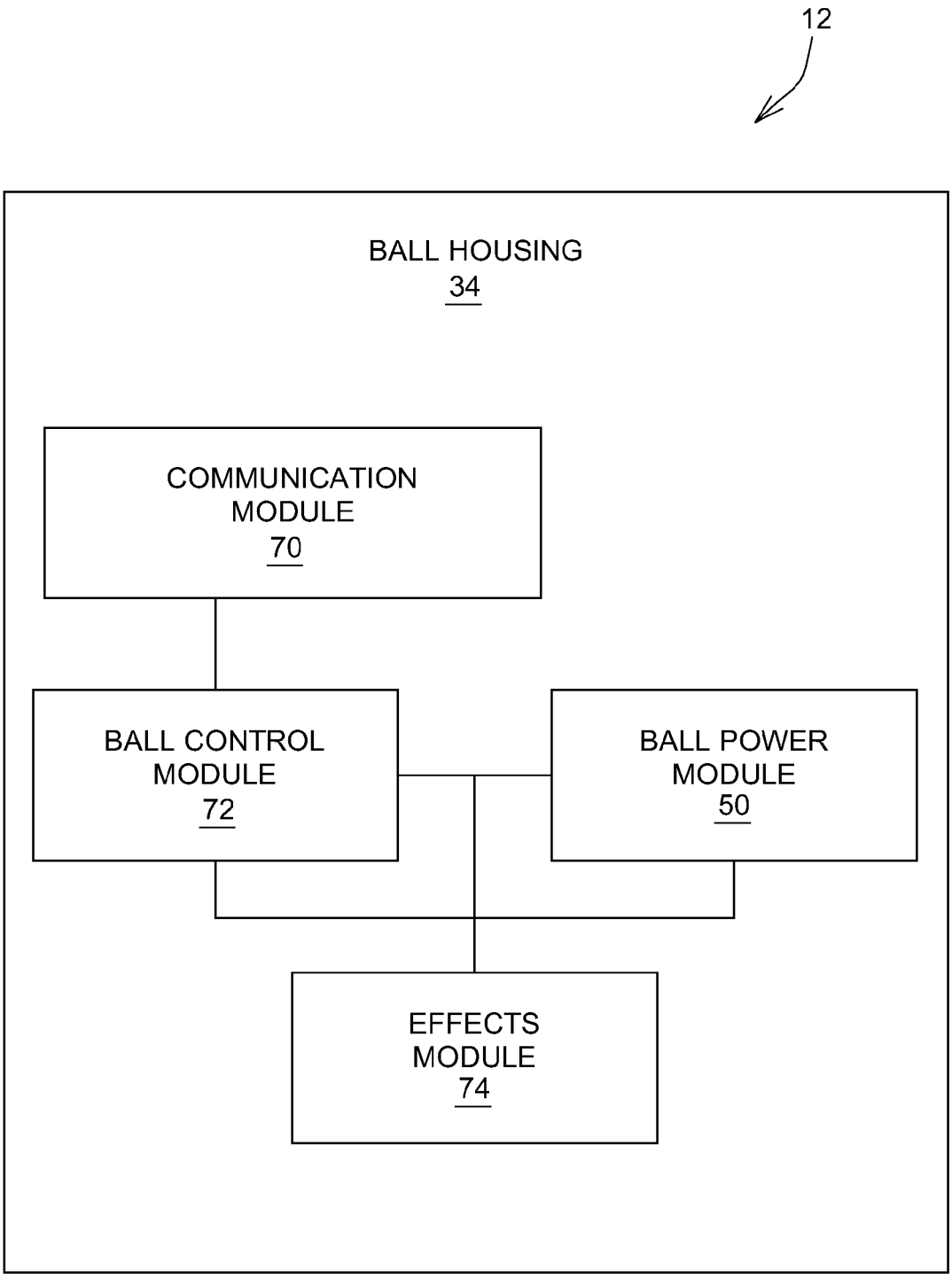
FIG. 6 is a module diagram of a light emitting ball of a lighted moving ball display system, according to one embodiment of the invention.

FIG. 6 is a module diagram of a light emitting ball of a lighted moving ball display system, according to one embodiment of the invention. There is shown a light emitting ball housing 34 including a ball communication module 70, a ball control module 72, a ball power module 50, and an effects module 74.

The illustrated light emitting ball 12 includes a ball housing 34. The housing 34 is configured to secure the components and modules of the light emitting ball 12, therein. The light emitting ball 12 includes a communication module configured to receive transmission/instructions from a control module of the lighted moving ball display system. The communication module 70 is in communication with a ball control module 72. The ball control module 72 is configured to provide operational controls or instructions to the modules and components of the light emitting ball 12. The ball control module 72 is in communication with a ball power module 50. The ball power module 50 is configured to provide power to the modules and components of the light emitting ball 12. The ball power module 50 is in communication with an effects module 74. The effects module is configured to provide sequenced or pre-determined lighting displays for each light emitting ball 12.

Figure 7:
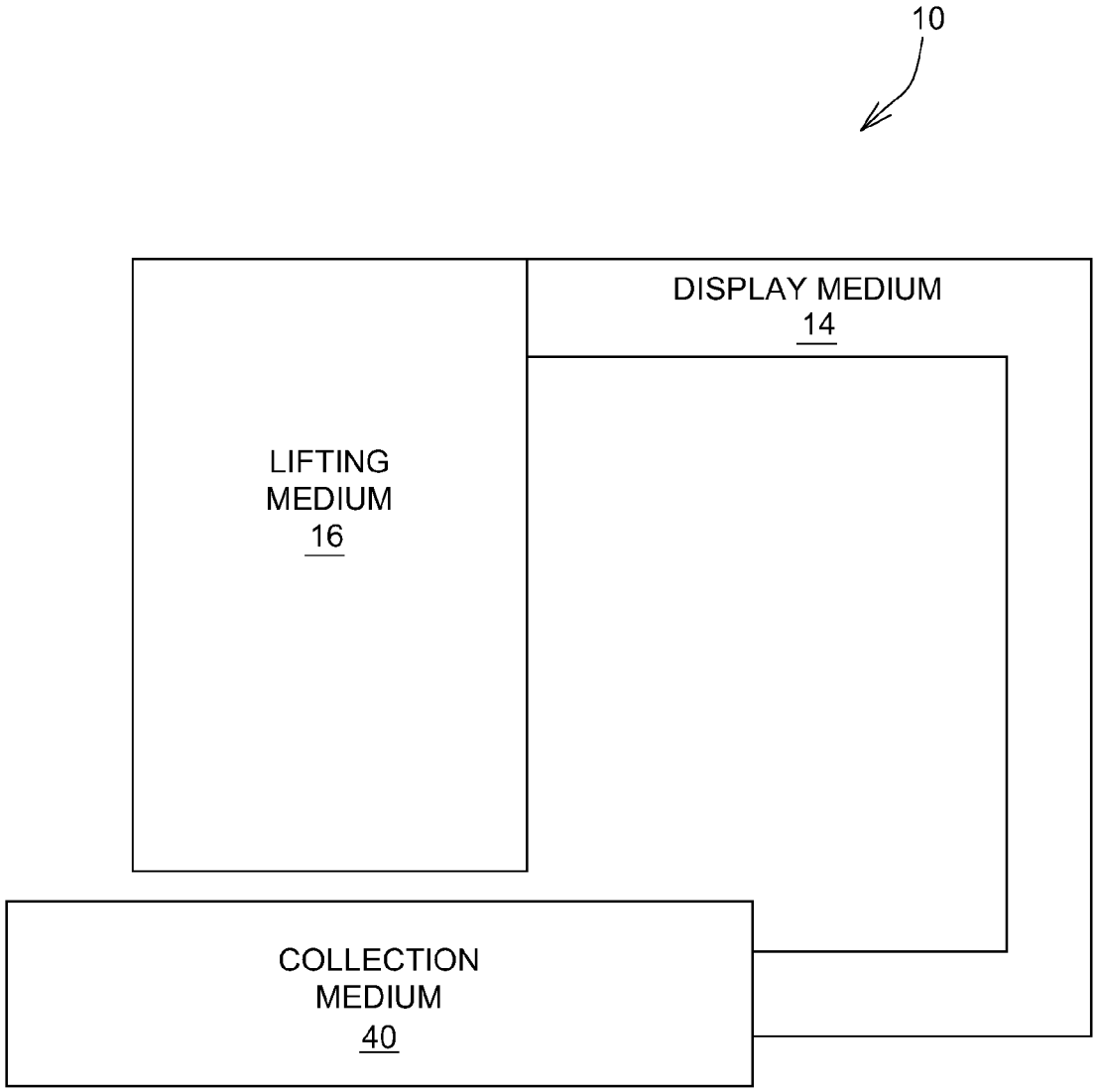
FIG. 7 is a diagram of a lighted moving ball display system, according to one embodiment of the invention.

FIG. 7 is a diagram of a lighted moving ball display system, according to one embodiment of the invention. There is shown a lighted moving ball display system 10 including a lifting medium 16, a display medium 14, and a collection medium 40.

The illustrated lighted moving ball display system 10 includes a display medium 14 configured to receive a plurality of light emitting balls. The plurality of light emitting balls are configured to traverse through the display medium 14 and provide a lighted display. The plurality of light emitting balls are configured to traverse through the display medium 14 and collect within a collection medium 40. The collection medium 40 is in communication with the display medium 14. The collection medium 40 is in communication with a transport medium 16. The lifting medium 16 is configured to transport the plurality of light emitting balls to a top portion of the display medium 14.

Figure 8:
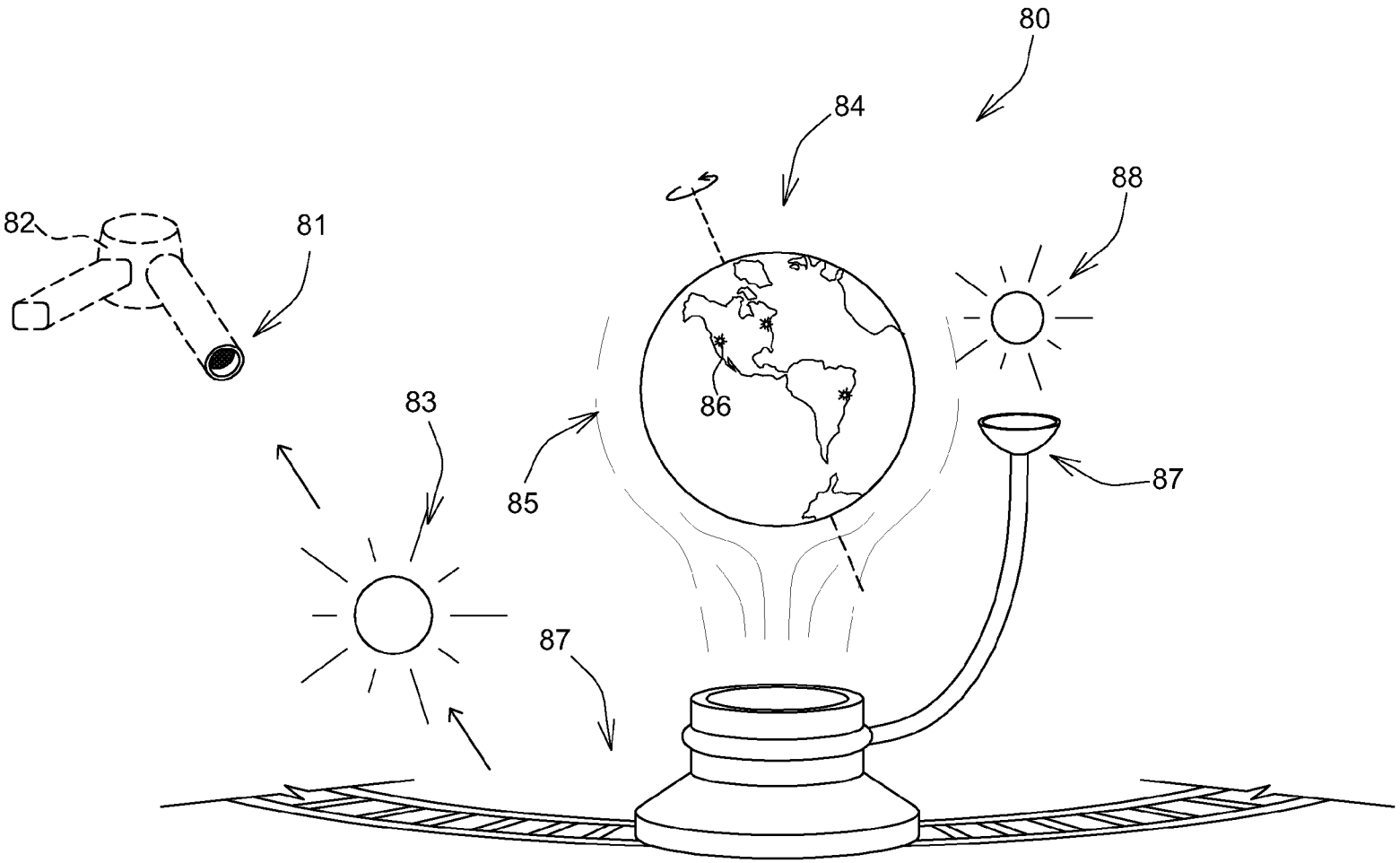
FIG. 8 is a perspective view of a lighted moving ball display system configured to represent a solar system, according to one embodiment of the invention.

FIG. 8 is a perspective view of a lighted moving ball display system configured to represent a solar system, according to one embodiment of the invention. Embodiments of modules described in FIG. 5 and other previous figures are illustrated therein and described below.

There is shown a lighted moving ball display system 80 including a receiving port 81 coupled to a ball collection module 82 coupled to a return feed that connects to a launcher (not shown) whereby a lighted ball 83 resembling a comet may be shot from the launcher to be received by the receiving port 81 and thereby circuited back to the launcher for repeated launchings.

There is also shown a lighted ball 84 resembling the Earth and including fiber optic terminations 85 coupled to a lighting system 86 such that lights resembling cities of the Earth may glow and emanate from the lighted ball 84. The lighted ball 84 that resembles the Earth is suspended over a vortex of air generated by a traveling support module 87 that has a particular angular component thereto such that the ball may rotate about a particular axis, simulating the rotating of the Earth that produces the day/night effect we experience thereon. The lighted ball 84 may be weighted such that a "southern" portion thereof may remain downwardly oriented. The illustrated traveling support module 87 includes a vortex generator (not shown) which may be a powered fan, a transport track whereby the traveling support module may be moved laterally such as but limited to moving the track and/or moving the housing across the track such as by a motor coupled to a wheel, a arm extending outwardly therefrom about an annular member that may circle the housing (powered and/or unpowered) wherein the arm includes a magnetized cup shaped end that repels a lighted ball 88 configured to represent a moon orbiting about the Earth. Other planets and the sun may also be included in a solar system display and may show surface details. A projector system may be included inside some planets such as Jupiter to show changing features such as the great red spot and other planetary storms.

Figure 9:
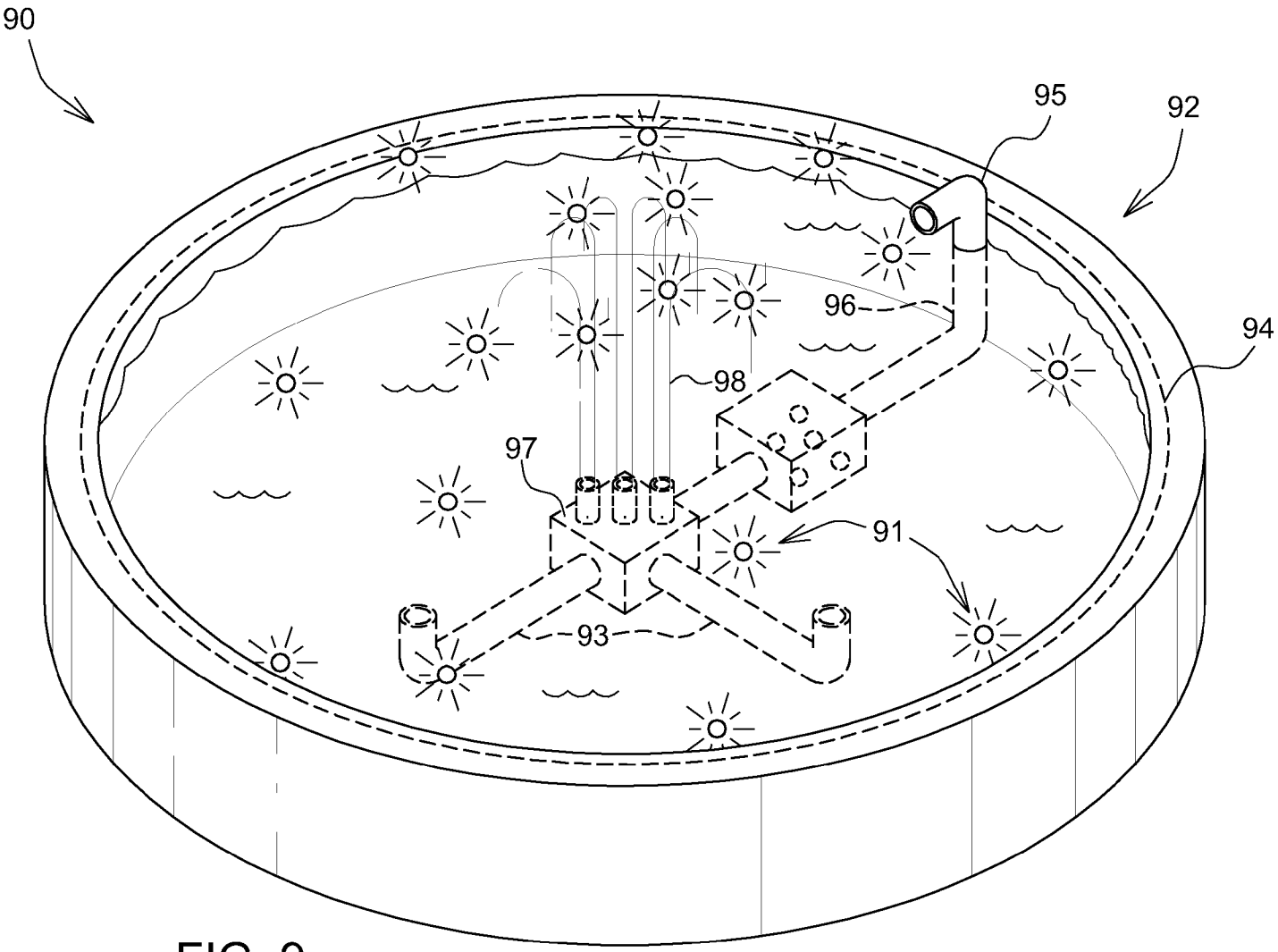
FIG. 9 is a perspective view of a lighted moving ball display system embodied in a fountain, according to one embodiment of the invention.

FIG. 9 is a perspective view of a lighted moving ball display system embodied in a fountain, according to one embodiment of the invention. Embodiments of modules described in FIG. 5 and other previous figures are illustrated therein and described below.

There is shown a lighted moving ball display 90 characterized as a fountain having an exterior wall 92 enclosing a body of fluid (water, etc.), wherein the water includes a plurality of floating lighted balls 91 that, when they reach a perimeter of the fountain are transported by a transport mechanism 94 to a receiving port 95 in communication with a collection module 96 that is coupled to a pump system 97 in communication with fluid intake ports 93 at the bottom of the body of water. Accordingly, lighted balls may be ejected out the fountain 98 to then float on a surface of the body of water until they reach a perimeter, whereby they are transported back to the pump system 97 to be ejected again. In one embodiment, balls may sink to a predetermined level, such as but not limited to configuring the balls with appropriate ballast in association with flotation characteristics of the balls in relation to the medium. In another embodiment, the body of fluid may include a plurality of fluids that may be non-mixed and one or more balls may float in a bottom layer of fluid but sink in a top layer of fluid, thereby causing the balls to reach a predetermined equilibrium in the body of fluid at a particular level.

The illustrated transport mechanism may include, but is not limited to: powered rollers oriented to impart momentum to the lighted balls in a direction of a receiving port, biased and/or ratcheting perimeter shapes/materials/structures/devices that react with contact with the balls in a asymmetrical manner such that the balls are generally directed towards a receiving port, water jets angled to push the balls towards a receiving port, and the like and combinations thereof.

The illustrated collection module may include one or more pumps, tracks, transport systems, conveyors, ball lifting augers and the like that may move the balls and/or fluid in which the balls may be suspended in a manner that the balls may be collected. The illustrated collection module includes a storage portion configured to store a large quantity of lighted balls such that balls may be collected and always in supply and then discharged in a predetermined order/sequence/speed/etc. to the pump system 97. Such may be controlled by one or more computerized systems/processors and may be automated and/or sequenced according to a visual display. Lighted balls may also be processed while in storage, such as but not limited to being recharged by a wireless/wired recharging module, configured by a wireless/wired configurations module that may functionally couple to a lighted ball and alter a configuration setting such as but not limited to changing an emitted color thereof, cleaned, polished, destroyed, coupled to another ball, augmented, turned off, turned on, dried, coated with a substance (oil, paint, dye, etc.), injected with a substance, weighted, de-weighted, and the like and combinations thereof which may be accomplished using one or more modules described herein and/or one or more modules described according to the function desired which one of ordinary skill in the art would be able to reproduce using knowledge of the art.

The illustrated pump system 97 may include one or more fluid pumps that may be configured to pump fluid only and/or to pump fluid containing particulates/granules, solid objects/solids/slurries/etc such as but not limited to the K-Tron Bulk Solids Pump (BSP) produced by K-Tron International, Inc. of Pitman, N.J. In one embodiment, there may be a pump configured only to pump fluid and the collection module may inject one or more lighted balls into an output stream of the pump such that the lighted ball may be carried away and into the air by the fluid ejected by the pump.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

The following are examples of benefits and/or contexts that may be associated with one or more embodiments of the invention: improve home values, entertainment, dance floors, lamps, signs, shows, fixtures, presentations, ornaments, displays, ambiance, floating in the air, fountains, healing aquariums, fireworks substitute.

The following are examples of options, variations, benefits and the like that may be associated with one or more of the embodiments described herein: free moving balls shoot out of water/air spouts, balls may float and/or sink to varying degrees at varying times and may include structures for effectuating such (controlled bladders and the like), lasers and/or fog may be utilized in association with a display, toy sized balls, balls too large to swallow, balls instead of fish in an aquarium and may be designed to simulate fish colors/patterns, safe balls shot into an audience during a concert, and/or color changing balls, system intake may sort by size or color or other characteristic to control which balls travel through which transport mechanisms, intake sorting may be dynamic and/or associated with a choreographed display plan, and/or wireless transmission/reception may be separated by color or other ball characteristic.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

For example, although the figures illustrate a lighted ball having a plurality of electrical contact pads, one skilled in the art would appreciate that the display includes an internal gyroscope that generates electricity inside the lighted balls as they spin, and wireless RF or induction power transmission. Rechargeable batteries may be included in any of these methods to keep the lighted balls lit when not being energized externally or by motion.

Additionally, although the figures illustrate a lifting mechanism, a plurality of lighted balls, a motor, a power module, a medium, a drum, a circulation module, one skilled in the art would appreciate that the modules, components, and mechanisms of the display may vary in size, shape, design, color, length, width, height, configuration and still perform its intended function.

It is expected that there could be numerous variations of the design of this invention. An example is that the lighted moving ball display is incorporated into casinos, amusement parks, malls, nightclubs, medical offices and other places where the masses gather. Custom lighted moving ball displays, shows, fixtures, fountains, waterfalls, and presentations may be configured in many different types of locations.

The following are non-limiting examples of various mediums/contexts wherein the lighted ball display may be implemented: fountain (home and garden, Vegas-style, indoor, fondue, etc.), stage, pool, cruise ship, lighting system of a building, tower, works of art, toys, roller coasters, Creative Ball Machines publicly located in places such as Newton's Daydream in the Salt Lake City Clark Planetarium, and etc. The following are non-limiting embodiments of modifications/variations on the lighted balls: resembling planets, resembling crystals, resembling fireworks, resembling ice cubes, resembling projectiles, and the like.

Ball transport may be effected in various ways, including but not limited to: gravity, chain lifts, corkscrew/auger lifts, air pressure, water pressure, buoyancy, air cannons, combinations thereof, and the like.

Ball lighting may be accomplished by batteries, electrical contact pads on balls in contact with electrical leads on tracks, wireless power transmission and reception, rechargeable batteries, motion activated internal power generation, chemical power generation, combinations thereof and the like.

Finally, it is envisioned that the components of the device may be constructed of a variety of materials, such as but not limited to plastic, plastic composite, metal, metal alloys, glass, textile, rubber, rubber composite, and still perform its intended function.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A lighted moving ball display system configured to provide a visual display, comprising:

a) a plurality of light emitting balls;

b) a passive transport medium configured to receive the balls and to permit the balls to traverse the medium under gravitational force;

c) a lifting mechanism functionally coupled to the passive transport medium and configured to lift the plurality of light emitting balls to a top portion of the medium;

d) a power module functionally coupled to the lifting mechanism and configured to provide power to the modules and components of the system; and e) a collection chamber functionally coupled to the passive transport medium and to the lifting mechanism and configured to store the plurality of light emitting balls.

2. The system of claim 1, further comprising a motivating apparatus functionally coupled to the medium and configured to actively urge the plurality of light emitting balls to traverse the medium.

3. The system of claim 2, wherein the motivating apparatus is an air pressure generator.

4. The system of claim 1, wherein the medium includes tubing.

5. The system of claim 1, wherein the medium includes a channel structure selected from the group of structures consisting of tubes, rails, tracks, ledges, ridges, banks, waves, grooves, slides, etc.

6. The system of claim 1, wherein the plurality of light emitting balls each include:

a) a light emitting device;

b) a ball power module configured to power the light emitting device; and c) a housing configured to secure the light emitting device and the ball power module, therein.

7. The system of claim 1, wherein the lifting mechanism includes:

a) a collection chamber in communication with the medium and configured to collect the plurality of lighted balls after moving through the medium;

b) a loading mechanism in communication with the collection chamber and configured to load the plurality of lighted balls into the lifting mechanism; and c) a lifting device in communication the loading mechanism and the collection chamber; wherein the lifting device includes lifting means, to lift a plurality of lighted balls to a top of the medium.

8. The system of claim 1, wherein the plurality of light emitting balls each include a wireless power receiver module.

9. The system of claim 1, wherein the power module includes a wireless power emission module.

10. A lighted moving ball display system configured to provide a visual display, comprising:

a) a plurality of light emitting balls; wherein the plurality of light emitting balls each include a wireless power receiver module;

b) a passive transport medium configured to receive the balls and to permit the balls to traverse the medium under gravitational force;

c) a lifting mechanism functionally coupled to the passive transport medium and configured to lift the plurality of light emitting balls to a top portion of the medium;

d) a power module functionally coupled to the lifting mechanism and configured to provide power to the modules and components of the system; wherein the power module includes a wireless power emission module; and e) a collection chamber functionally coupled to the passive transport medium and to the lifting mechanism and configured to store the plurality of light emitting balls.

11. The system of claim 10, further comprising a motivating apparatus functionally coupled to the medium and configured to actively urge the plurality of light emitting balls to traverse the medium.

12. The system of claim 11, wherein the motivating apparatus is a air pressure generator.

13. The system of claim 12, wherein the medium includes tubing.

14. The system of claim 13, wherein the medium includes a channel structure selected from the group of structures consisting of tubes, rails, tracks, ledges, ridges, banks, waves, grooves, slides, etc.

15. The system of claim 14, wherein the plurality of light emitting balls each include:

a) a light emitting device;

b) a ball power module configured to power the light emitting device; and c) a housing configured to secure the light emitting device and the ball power module, therein.

16. The system of claim 15, wherein the lifting mechanism includes:

a) a collection chamber in communication with the medium and configured to collect the plurality of lighted balls after moving through the medium;

b) a loading mechanism in communication with the collection chamber and configured to load the plurality of lighted balls into the lifting mechanism; and c) a lifting device in communication the loading mechanism and the collection chamber; wherein the lifting device includes lifting means, to lift a plurality of lighted balls to a top of the medium.

17. A lighted moving ball display system configured to provide a visual display, comprising:

a) a plurality of light emitting balls; wherein the plurality of light emitting balls each include:

a1) a light emitting device;

a2) a ball power module configured to power the light emitting device;

a3) a housing configured to secure the light emitting device and the ball power module, therein; and a4) a wireless power receiver module;

b) a passive transport medium configured to receive the balls and to permit the balls to traverse the medium under gravitational force; wherein the medium includes tubing;

c) a lifting mechanism functionally coupled to the passive transport medium and configured to lift the plurality of light emitting balls to a top portion of the medium;

wherein the lifting mechanism includes:

c1) a collection chamber in communication with the medium and configured to collect the plurality of lighted balls after moving through the medium;

c2) a loading mechanism in communication with the collection chamber and configured to load the plurality of lighted balls into the lifting mechanism; and d) a lifting device in communication the loading mechanism and the collection chamber; wherein the lifting device includes lifting means, to lift a plurality of lighted balls to a top of the medium;

e) a power module functionally coupled to the lifting mechanism and configured to provide power to the modules and components of the system; wherein the power module includes a wireless power emission module;

f) a collection chamber functionally coupled to the passive transport medium and to the lifting mechanism and configured to store the plurality of light emitting balls; and g) a motivating apparatus functionally coupled to the medium and configured to actively urge the plurality of light emitting balls to traverse the medium; wherein the motivating apparatus is an air pressure generator.

18. The system of claim 17, wherein the medium includes a channel structure selected from the group of structures consisting of tubes, rails, tracks, ledges, ridges, banks, waves, grooves, slides, etc.

* * * * *